US005150888A

United States Patent [19]

Durfee

[11] Patent Number: 5,150,888

[45] Date of Patent: Sep. 29, 1992

[54] CLAMPING MECHANISM IN A VISE JAW ACCESSORY SYSTEM FOR ATTACHING AND RELEASING VISE ACCESSORIES WHILE MAINTAINING POSITIONAL ACCURACY OF THE ACCESSORIES

[75] Inventor: David L. Durfee, Meadville, Pa.

[73] Assignee: Susan M. Durfee, Meadville, Pa.

[21] Appl. No.: 780,119

[22] Filed: Oct. 21, 1991

Related U.S. Application Data

[63] Continuation-in-part of Ser. No. 636,250, Dec. 31, 1990, Pat. No. 5,065,990, which is a continuation-in-part of Ser. No. 495,777, Mar. 19, 1990, Pat. No. 5,037,075, which is a continuation of Ser. No. 223,428, Jul. 25, 1988, Pat. No. 4,923,186, which is a continuation-in-part of Ser. No. 941,717, Dec. 15, 1986, abandoned.

[51] Int. Cl.[5] ..... B25B 1/24; B25B 1/00

[52] U.S. Cl. ..... 269/254 CS; 269/271; 269/280; 269/282

[58] Field of Search ..... 269/261, 262, 271, 275, 269/279, 280, 281, 282, 283, 284, 254 CS

[56] References Cited

U.S. PATENT DOCUMENTS

| | | | |
|---|---|---|---|
| 81,764 | 9/1868 | Fisher . | |
| 92,331 | 7/1869 | Mason . | |
| 234,930 | 11/1880 | Stephens . | |
| 1,212,123 | 1/1917 | Anderson . | |
| 1,579,582 | 1/1923 | Voltz . | |
| 2,284,449 | 8/1939 | Rodess | 81/39 |
| 2,392,310 | 10/1942 | Chrestoff | 81/38 |
| 2,665,598 | 1/1952 | Hardy | 77/62 |
| 2,880,638 | 11/1956 | Muggli et al. | 81/33 |
| 3,088,729 | 5/1963 | Marcus | 269/254 CS |
| 3,186,706 | 6/1965 | Felice | 269/136 |
| 3,226,104 | 12/1965 | Preisser | 269/227 |
| 3,341,190 | 9/1967 | Adamson | 269/271 |
| 3,368,808 | 2/1968 | Worthington | 269/279 |
| 3,617,046 | 11/1971 | Sotonyi | 269/254 CS |
| 3,685,817 | 8/1972 | Worthington | 269/139 |
| 3,799,533 | 3/1974 | Malott | 269/32 |
| 4,019,726 | 4/1977 | Turner | 269/261 |
| 4,251,066 | 2/1981 | Bowling | 269/283 |
| 4,519,592 | 5/1985 | Russell | 269/283 |
| 4,582,306 | 4/1986 | Sassenberg | 269/134 |
| 4,736,935 | 4/1988 | Vasapolli | 269/282 |
| 4,874,156 | 10/1989 | Goldzweis | 269/254 CS |
| 4,923,186 | 5/1990 | Durfee | 269/282 |
| 4,960,264 | 10/1990 | Fong | 269/254 CS |
| 5,037,075 | 8/1991 | Durfee, Jr. | 269/282 |

*Primary Examiner*—J. J. Swann

*Attorney, Agent, or Firm*—Oliff & Berridge

[57] ABSTRACT

A vise jaw system for a vise having a horizontal datum surface at least one removable jaw for selective attachment to the vise, the removable jaw having a bottom surface held in fixed relation to the horizontal datum surface and a front surface perpendicular to the horizontal datum surface. The removable jaw also includes a recess formed in at least the bottom surface of the removable jaw. At least one positioning plate is selectively attached to the removable jaw, the positioning plate having a bottom face contacting the horizontal datum surface and a rear face perpendicular to the horizontal datum surface. The positioning plate further includes a cleat fixed to the positioning plate adjacent to the bottom face of the positioning plate, the cleat having a shape sized for reception in the recess. Pressure devices are located in one of the removable jaw and the cleat for engaging the cleat when received in the recess to urge the bottom face of the positioning plate against the horizontal datum surface. The pressure devices include, in a single mechanism, and arrangement for applying a biasing force to the cleat and an arrangement for disabling the biasing force and locking the cleat in position. In one embodiment of the invention, the recess has a lateral length less than the lateral length of the bottom surface of the removable jaw, such that the cleat of the positioning plate enters the recess in a longitudinal direction. The system also has a lateral alignment mechanism for laterally aligning the positioning plate relative to the vertical datum surface upon longitudinal insertion of the cleat within the recess.

21 Claims, 14 Drawing Sheets

CLAMPING MECHANISM IN A VISE JAW ACCESSORY SYSTEM FOR ATTACHING AND RELEASING VISE ACCESSORIES WHILE MAINTAINING POSITIONAL ACCURACY OF THE ACCESSORIES

CROSS REFERENCE TO RELATED APPLICATIONS

This application is a continuation-in-part of U.S. Ser. No. 07/636,250 filed Dec. 31, 1990, now U.S. Pat. No. 5,065,990 which is a continuation-in-part of U.S. Ser. No. 07/495,777 filed Mar. 19, 1990 (now U.S. Pat. No. 5,037,075), which in turn is a continuation of U.S. Ser. No. 223,428 filed Jul. 25, 1988 (now U.S. Pat. No. 4,923,186), which in turn is a continuation-in-part of U.S. Ser. No. 941,717 filed Dec. 15, 1986, now abandoned.

BACKGROUND OF THE INVENTION

1. Field of the Invention

The invention relates to a clamping mechanism in a vise jaw accessory system for attaching and releasing vise accessories, such as positioning plates. More particularly, the invention relates to a clamping mechanism for a vise jaw accessory system for attaching and releasing accessories to and from a vise while maintaining the positional accuracy of the accessory in three directions relative to a horizontal datum surface and vertical longitudinal and lateral datum surfaces. The clamping mechanism combines a locking screw arrangement with a spring biased detent arrangement for providing a biasing pressure to hold a workpiece such as a positioning plate, and a locking pressure to disable the bias pressure and lock the workpiece in position.

2. Discussion of Related Art

U.S. Pat. No. 4,923,186 (the disclosure of which is herein incorporated by reference) discloses a mechanism for lateral insertion of a positioning plate into a recess within a vise jaw. That construction is adequate for many purposes, but often times greater positional accuracy is desired in the lateral direction, particularly in "mirror image" situations when two positioning plates face each other on opposing jaws and must be aligned laterally so as not to skew the work piece held between the plates during machining. Further, insufficient space may exist for lateral insertion of the positioning plates. That construction also provides separate mechanisms such as a spring-biased detent for providing a bias pressure against the positioning plate, and a set screw for providing a locking pressure on the positioning plate.

SUMMARY OF THE INVENTION

It is an object of the present invention to provide an improvement over the structure disclosed in U.S. Pat. No. 4,923,186 by combining the spring biased detent and set screw arrangements into a single mechanism.

It is a further object of the present invention to obtain greater positional accuracy in the lateral direction for mirror image situations.

An additional object of the present invention is to provide a vise jaw accessory system in which the positioning plate is accurately positioned in three directions relative to a horizontal datum surface and vertical longitudinal and lateral datum surfaces.

Another object of the invention is to provide a vise jaw accessory system in which vise accessories such as positioning plates are inserted in the longitudinal direction of the vise.

It is another object of the invention to provide a vise jaw accessory system in which the accessories are readily released in the longitudinal direction of the vise.

These and other objects are obtained by the inventive vise jaw system for a vise having a horizontal datum surface and at least one removable jaw for selective attachment to the vise, the removable jaw having a bottom surface held in fixed relation to the horizontal datum surface and a front surface perpendicular to the horizontal datum surface. The removable jaw also includes a recess formed in at least the bottom surface of the removable jaw. At least one positioning plate is selectively attached to the removable jaw, the positioning plate having a bottom face contacting the horizontal datum surface and a rear face perpendicular to the horizontal datum surface. The positioning plate further includes a cleat fixed to the positioning plate adjacent to the bottom face of the positioning plate, the cleat having a shape sized for reception in the recess. Pressure means are located in one of the removable jaw and the cleat for engaging the cleat when received in the recess to urge the bottom face of the positioning plate against the horizontal datum surface. The pressure means includes, in a single mechanism, an arrangement for applying a bias force to the cleat and an arrangement for disabling the biasing force and locking the cleat in position.

In one embodiment of the invention, the recess has a lateral length less than the lateral length of the bottom surface of the removable jaw, such that the cleat of the positioning plate enters the recess in a longitudinal direction.

In a further embodiment of the invention, the pressure means in one of the removable jaw and the cleat cooperates with a notch or depression in the other of the removable jaw and the cleat, wherein the notch or depression has a centerline offset from a centerline of the pressure means such that insertion of the pressure means within the notch or depression urges the cleat in the lateral direction for alignment with the vertical datum surface.

In a further embodiment of the invention, the cleat has a lateral length corresponding to the lateral length of the recess to provide contact between a side wall of the recess and a side wall of the cleat for lateral alignment of the positioning plate.

In a further embodiment of the invention, the positioning plate includes a key depending from the bottom face of the positioning plate and sized to fit within the keyway of the vise for lateral alignment with the vertical datum surface of the vise.

In another embodiment of the invention, the vise jaw system is provided with a release mechanism actuable against the pressure means for selectively urging the cleat in a release direction opposite to the securement direction to release the cleat from the recess.

Another embodiment of the invention is directed towards a head bolt locking mechanism for contacting the threaded bolt securing the removable jaw to the vise to lock the removable jaw against movement in lateral and vertical directions.

BRIEF DESCRIPTION OF THE DRAWINGS

The invention will be described with reference to the attached drawings in which like elements bear like references numerals, and wherein.

DETAILED DESCRIPTION OF THE PREFERRED EMBODIMENTS

Figure 1:
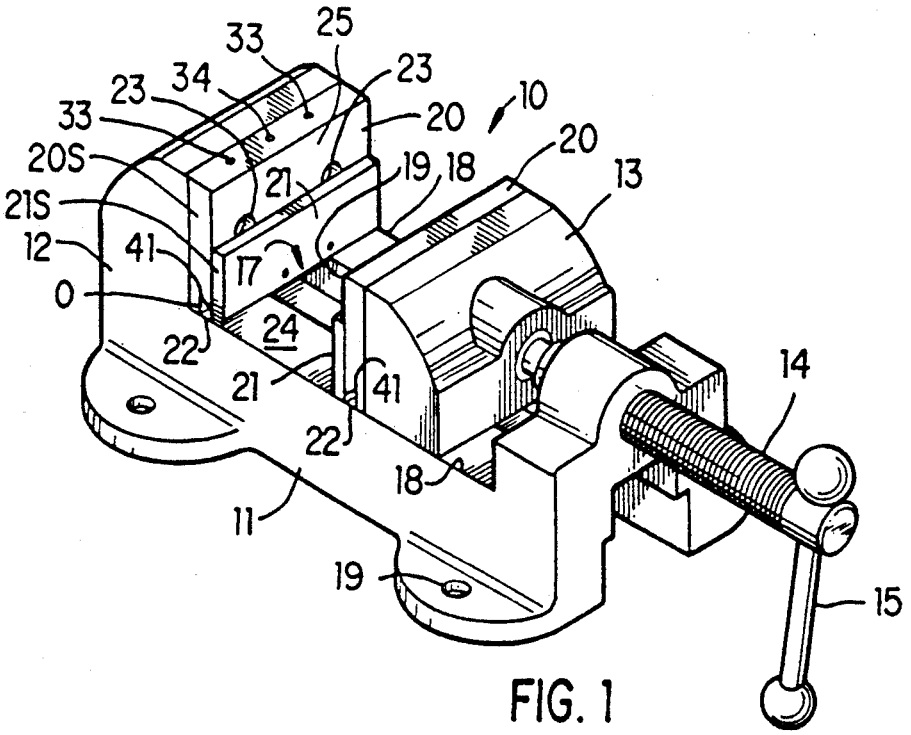
FIG. 1 is an isometric view of a machine vise with a parallel system supported on it according to the one aspect of the invention.

FIG. 1 illustrates a conventional vise 10 including the improved vise jaw system. The vise 10 has a base 11, a fixed jaw 12 fixed to the base 11 and a movable jaw 13 slidably supported on a base 11 and having a screw 14 threadably received in base 11 for engaging the movable jaw 13 to move it toward and away from the fixed jaw 12. A handle 15 extends through the screw 14 for rotating the screw and moving the movable jaw 13 relative to the fixed jaw 12 in a longitudinal direction of the vise. The rotation of the screw 14 may be manually controlled or computer controlled.

The base 11 includes two precisely aligned and parallel rails 18 with a space or keyway 17 therebetween. The rails 18 extend in the longitudinal direction of the vise, but the keyway 17 extends in a lateral or keyway direction of the vise perpendicular to the longitudinal direction. The rails 18 are precisely machined such that each rail has a horizontal datum or reference surface 24 and a vertical datum or reference surface 19. The vertical datum surface 19 extends in longitudinal direction for aligning accessories in the lateral direction, as detailed below. The vertical datum surface 19 is referred to as a vertical lateral datum surface since it is used for lateral alignment. The horizontal and vertical datum surfaces 24, 19 are precisely machined such that all measurements can be taken from the surfaces as benchmarks or reference surfaces.

Removable jaw plates are held to the fixed and movable jaws 12, 13 by bolts 23 in fastening bores 23A. While the invention is described below with reference to removable jaw plates 20 attached to fixed and movable jaws 12, 13, the structure detailed herein can be incorporated directly into recesses 41 in the fixed and movable jaws 12, 13 to eliminate the removable jaw plate 20. For example, the vise 10 illustrated in FIGS. 8A and 8B includes recesses 41 having the structure of the removable jaw plates built into the fixed and movable jaws. Further, the fixed and movable jaws 12, 13 in the vise of FIGS. 8A and 8B can be made removable from the base 11. Accordingly, the invention will be described with reference to a removable jaw 20, because it is recognized that the invention can be incorporated into recesses machined into removable jaw plates that are attached to the fixed and movable jaws, or that the invention can be incorporated into recesses machined directly into the fixed and movable jaws removably attached to the vise.

Parallel positioning plates 21 are held to fixed jaw 12 and to movable jaw 13 respectively by means of cleats 22, which are received in complementary shaped recesses or slots 41 at the lower edge of the removable jaws 20. The bottom surface of the movable jaw 13, as well as the bottom surface of the parallel positioning plate 21 and cleat 22, slide over the horizontal datum surface 24 when the screw 14 is rotated by the handle 15.

Figure 3:
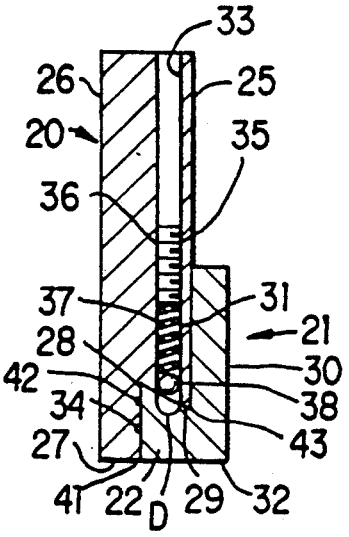
FIG. 3 is a longitudinal cross sectional view of the vise of FIG. 1 through a bore 33.

As shown in FIG. 3, removable jaws 20 are in the form of rectangular shaped plates with a parallel front surface 25 which is parallel to rear surface 26 and both surfaces 25, 26 are perpendicular to bottom surface 27. The front surface 25 is perpendicular to the horizontal datum surface 24 and extends in the lateral direction, thus functioning to align accessories in the longitudinal direction. The front surface 25 is a vertical longitudinal datum surface since it is used for alignment in the longitudinal direction. Two side surfaces 20S are defined between the front and rear surfaces 25, 26 (see FIG. 1). The slot or recess 41 in the front surface 25 has a back surface 42 and a top surface 43 that inclines upwardly and toward back surface 42. The parallel positioning plate 21 has front face 30 and rear face 31 parallel to it which are both perpendicular to bottom face 32. Two side faces 21S are defined between the front and rear faces 30, 31 (see FIG. 1).

Cleat 22 has a flat bottom face that is a continuation of bottom face 32 of the parallel positioning plate 21, a rear face 28 and a top face 29 that inclines downwardly and toward the rear face 31. Each cleat 22 is complementary and shaped to the corresponding recess 41 in the lower edge of each removable jaw 20. The removable jaw 20 has two spaced bores 33 which are threaded at 35 and receive a threaded screw 36 that engages spring 37 and urges detent member 38 into engagement with the top face 29 of cleat 22. The detent member 38 acts as a pressure mechanism and may be in the shape of a ball as shown in the drawing, or may be made in other configurations adapted to engage the cleat 22. The tension on spring 37 may be increased by adjusting the threaded screw 36. In other embodiments of the invention, the bore 33 for the detent 38 need not extend to the top surface of the removable jaw.

Figure 2:
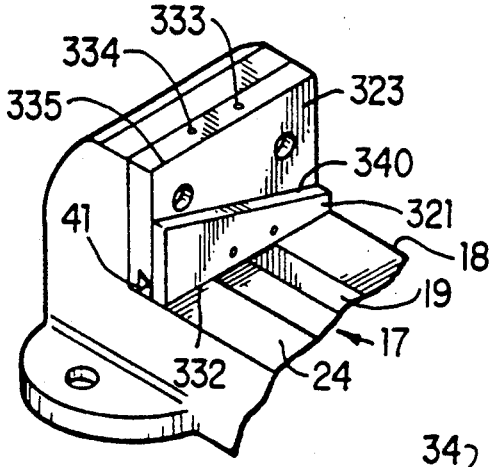
FIG. 2 is a partial view of the vise and parallel system shown in FIG. 1 with a parallel having an inclined top according to the invention.

In the embodiment of FIGS. 1–2, the slot 41 has a length equal to the length of the removable jaw 20 between the side surfaces 20S in the lateral keyway direction. An opening O thus exists in the side surfaces 20S. The cleat 22, while complementary in shape to the slot 41, may have a length equal to or less than the length of the slot 41 as long as the cleat 22 provides sufficient length of top surface 29 for engagement with the detent member 38 and a sufficient length of bottom face 32 to span the keyway 17 between rails 18. In the embodiment of FIGS. 1–6, the parallel positioning plate 21 is inserted in the lateral keyway direction by sliding the cleat into the opening 0 in either side surface 20S of the removable jaw 20. The plate 21 is slid into the slot 41 until the sides 21S of the positioning plate are laterally aligned with the sides 20S of the removable jaw 20. To facilitate lateral alignment and hold the plates 21 laterally in place, the cleat 22 may be provided with depressions D, preferably concave depressions, that are positioned to receive the detents 38 when the positioning plate 21 is laterally aligned relative to the removable jaw 20. To remove the positioning plate 21, the cleat 22 is slid laterally through the recess 41 and out of the opening O.

The detents 38 are located within the removable jaw 20 to press the cleat downwardly. However, the detents 38 may be located within the cleat 22 for engagement with correspondingly positioned depressions in the top surface of the recess 41 of the removable jaw. Whether located in the cleat 22 or removable jaw 20, the detents 38 act as a pressure means to urge the bottom face 32 of the positioning plate against the horizontal datum surface 24 and hold it securely in position without subsequent movement of the positioning plate.

In addition to detents 38, or as a substitute for the detents 38, the pressure means may include a set screw 136 (FIG. 4) in a correspondingly threaded bore 34, preferably located in the removable jaw 20 between the bores 33 for the detents 38. The set screw 136 (FIG. 4) is selectively extended or retracted relative to the slot 41 to selectively engage the top face 29 of the cleat 22 to hold the positioning plate laterally in position while urging the bottom face 32 of the positioning plate against the horizontal datum surface 24. In a preferred embodiment, the cleat 22 has a lock notch 136N (see FIG. 4) aligned with the set screw 136 and positioned to receive a locking end 136L of the set screw 136 when the positioning plate 21 is laterally aligned relative to the removable jaw 20. In operation, the set screw is retracted out of the recess 41 and the cleat 22 of the positioning plate is slid into the opening O with the detents 38 being urged against the force of the spring 37 but still urging the bottom face 32 of the positioning plate 21 against the datum surface 24. The positioning plate 21 is slid into lateral alignment with the removable jaw 20, and preferably the detents 38 engage the depressions D when lateral alignment is achieved. The set screw 136 is then extended into the notch 136 end to hold the plate 21 in its lateral position. The set screw 136 may be eliminated if the spring force of the detents 38 is sufficient to hold the lateral position of the plate.

Figure 4:
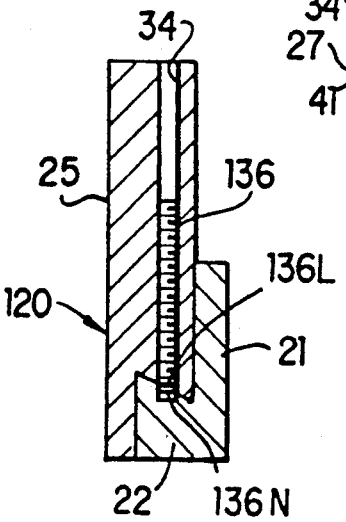
FIG. 4 is a cross sectional view similar to FIG. 3 showing a cross sectional view of the vise through a bore 34.
Figure 5:
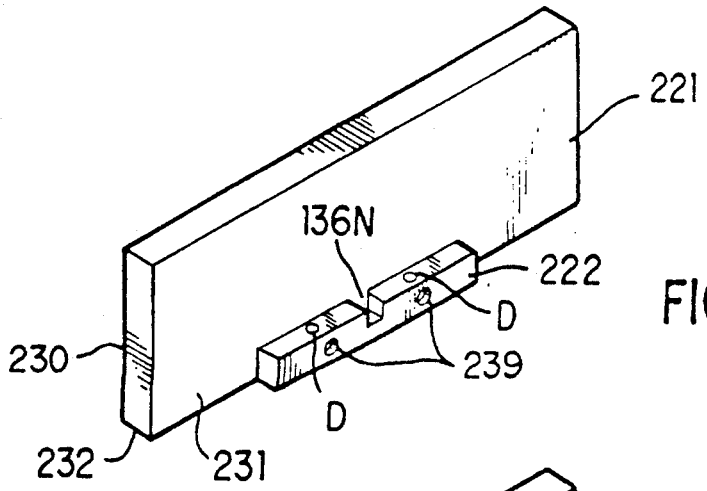
FIG. 5 is an isometric view of another embodiment of the parallel for a machine vise.

Parallel positioning plate 221 shown in FIG. 5 has a front surface 230, a rear surface 231 and a bottom surface 232 and is similar in shape and configuration to parallel positioning plate 21 shown in FIG. 3, except that the cleat is rectangular in cross-section. Further, cleat 222 is removable and threadably attached to parallel positioning plates 221 by means of screws 239 which clamp cleat 222 to parallel positioning plate 221. Cleat 222 will fit in a recess 41 of complementary rectangular shape in the removable jaw 20 and is held in place by detents or screws such as 38 and 136 as shown in the embodiment of FIGS. 1, 3 and 4. The cleat 222 is illustrated as including the depressions D for the detents 38 and the lock notch 136N for the lock screw 136.

Angle positioning plate 321 shown in the embodiment of the invention shown in FIG. 2 may have a cleat shaped like any of those shown in the embodiments of FIGS. 1 and 3–7, but its upper edge 340 is inclined relative to the bottom surface 332 of the angle positioning plate 321, thus allowing a work piece being held in the vise to be supported at a predetermined position. Depending on the angle desired, several angle positioning plates with various top surface angles may be provided.

Figure 6:
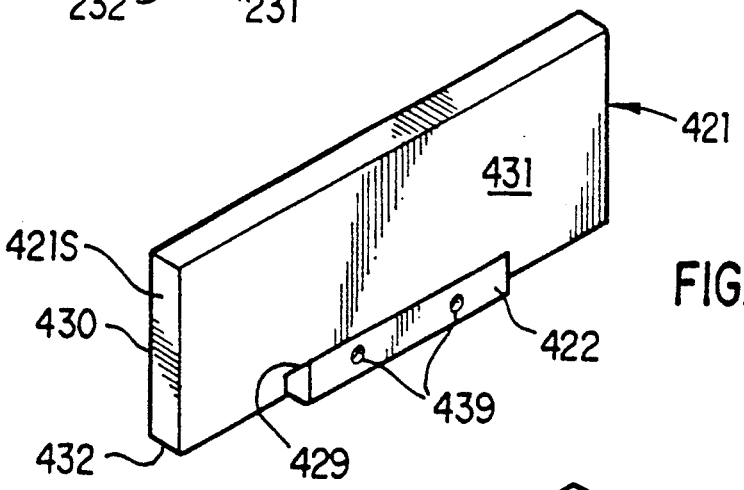
FIG. 6 is an isometric view of another form of cleat removably supported on the jaw.

The embodiment of the invention shown in FIG. 6 has a cleat 422 fixed to the rear surface 431 of parallel positioning plate 421. Parallel positioning plate 421 has a front surface 430, a bottom surface 432 and side surfaces 421S similar to the other embodiments. The cleat 422 is attached to the parallel positioning plate by screws 439 and has an inclined upper surface 429 similar to the top surface 29 shown in FIG. 3. The length of the cleat 422 is less than the lateral length of the plate 421 between the sides 421S.

Figure 7:
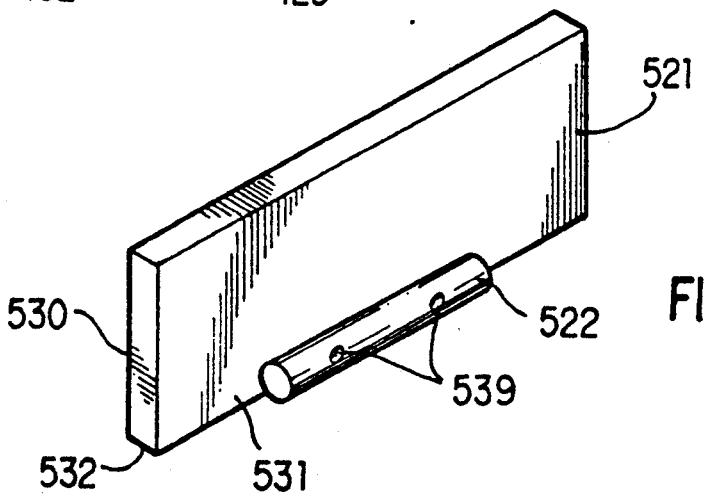
FIG. 7 is an isometric view of yet another form of the parallel cleat.

In the embodiment of the invention shown in FIG. 7, parallel positioning plate 521 has a front surface 530, a rear surface 531, a bottom surface 532 and a cylindrical shaped cleat 522 held in place by screws 539. The removable jaw of the milling machine vise will have a slot at its bottom complementary in shape to cylindrical cleat 522.

Cleats may be attached to the parallel positioning plates by screws or other means but can be of one unit such as being cast complete or being machined out of one piece as a complete unit as shown in FIG. 3.

In the embodiments of FIGS. 1-7, the recess 41 preferably extends across the entire lateral length of the removable jaw 20, and the positioning plate 21 is slid into position by inserting it in the lateral direction into the opening 0 in the side surfaces 20S until lateral alignment is achieved, such lateral alignment being enhanced by the set screw 136 and locking notch 136N and/or depressions D for receiving detents 38. However, lateral alignment can be improved (with an attendant improvement in positioning accuracy) with the embodiment illustrated in FIGS. 8-20. It is noted that lateral alignment of the positioning plate 21 relative to the removable jaw 20 becomes particularly necessary in mirror image situations when two positioning plates face each other on opposing vise jaws, and each plate must be precisely laterally aligned with its corresponding opposing plate.

Figure 8A:
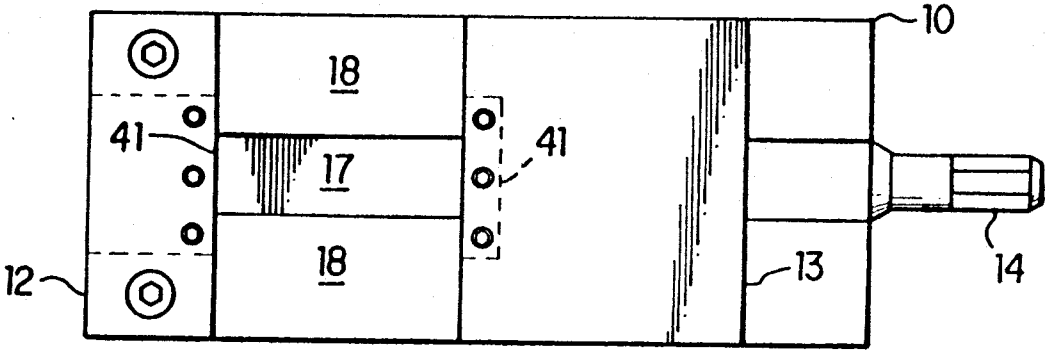
FIGS. 8A and 8B are top and side views of a vise to which the teachings of the invention are applicable.
Figure 8B:
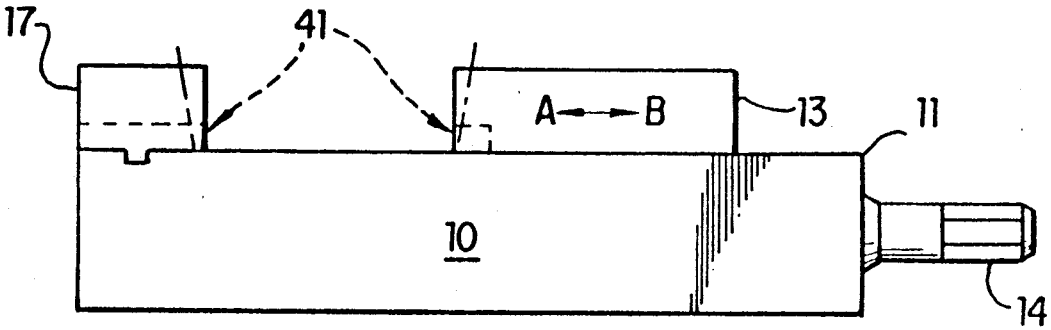

In FIGS. 8A-8B, the recess 41 has a length less than the lateral length of the removable jaw but greater than the width of the keyway 17, and the positioning plate 21 is inserted in the longitudinal direction of the vise as represented by the arrow in FIG. 8B. As described in more detail hereinafter, the positioning plate 21 is thus drawn by the pressure means toward the removable jaw 20 in a securement direction and removed away from the removable jaw in a release direction.

Figure 9:
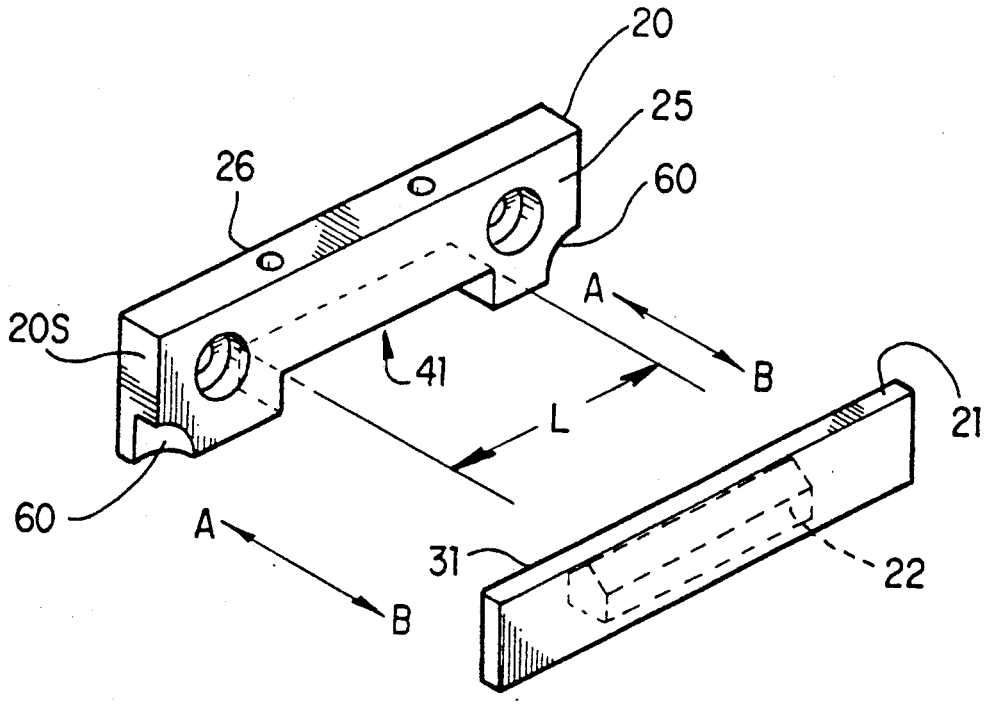
FIG. 9 is a perspective view of a removable jaw and positioning plate according to a second aspect of the invention.

FIG. 9 illustrates longitudinal insertion of a positioning plate 21 in a removable jaw 20. The securement direction is illustrated by arrow A and the release direction by arrow B. The plate 21 has a cleat 22 sized to fit snugly within the recess 41 of the jaw 20 to enhance lateral alignment as described below with reference to FIGS. 12 and 13. The lateral length of the recess matches the lateral length of the cleat 22 thus ensuring lateral alignment of the positioning plate. The depth of the recess 41 in the longitudinal direction is less than the thickness of the cleat 22 so that a space exists in the recess 41 between the rear surface 26 of the jaw and the rear face 28 of the cleat. To facilitate release of the plate 21 in the longitudinal direction, the jaw 20 may be provided on one or both of its side surfaces 20S with finger recesses 60. The finger recesses 60 open in the front surface 25 of the jaw 20 so that an operator's finger may be placed in the finger recess 60 behind the positioning plate 21. The operator can thus exert pressure on the rear face 31 of the positioning plate 21 to urge the positioning plate in the release direction B.

Figure 10:
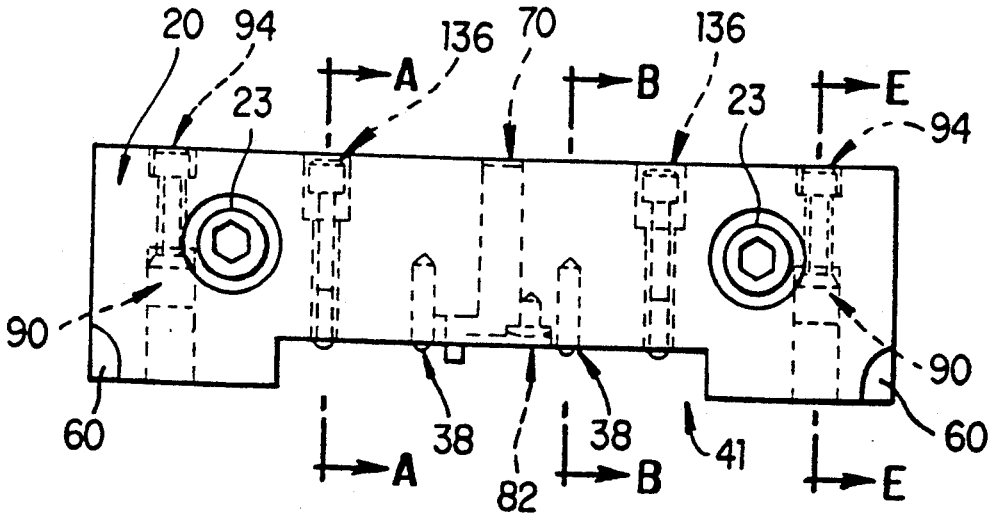
FIG. 10 is a front view of a removable jaw in accordance with the second aspect of the invention.

FIG. 10 illustrates a removable jaw which accepts longitudinal insertion of a positioning plate in the securement direction. The jaw 20 includes a recess 4 into which extends two set screws 136, detents 38, bolt head locks 90 with engagement screws 94, and a release mechanism 70 retained in the jaw 20 by a retainer screw 82, all of which are described below in relation to two types of positioning plates 21A, 21B illustrated respectively in FIGS. 12A and 12B. The lock screw 136 (see FIG. 11A) is preferably angled toward the front surface of the jaw so as not to weaken the jaw. The detent 38 (see FIG. 11B) is preferably located adjacent the front surface of the jaw 20 to draw the cleat in the securement direction.

Figure 12A:
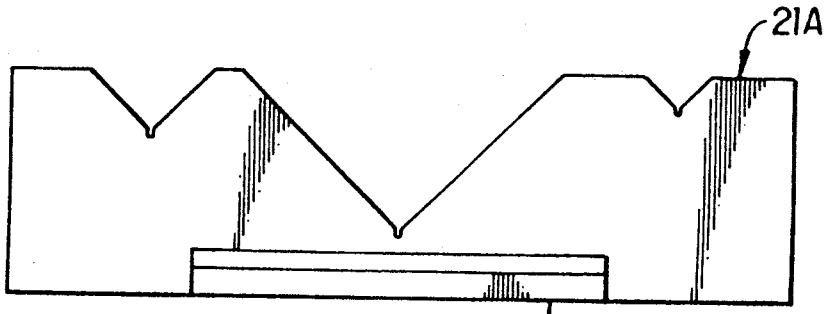
FIGS. 12A and 12B are plan views of two types of positioning plates used with the jaw 20 of FIG. 10.
Figure 12B:
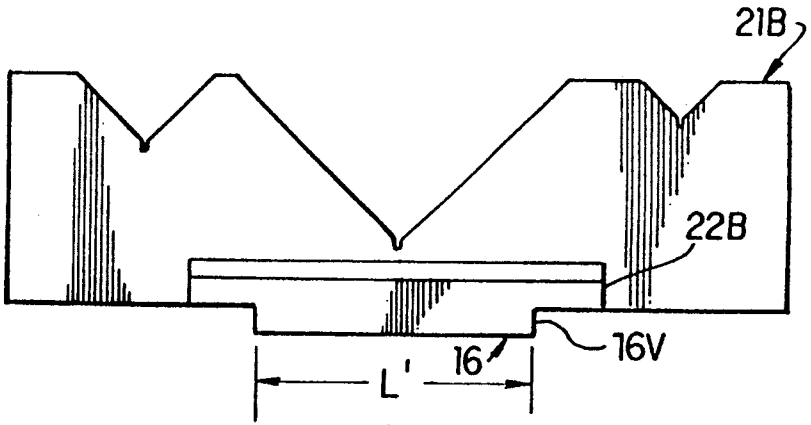

In FIG. 12A, the plate 21A is a 45° angle positioning plate in which the cleat 22A has a length precisely machined to match the length of the recess so that insertion of the cleat 22 in the recess automatically laterally aligns the positioning plate 21 in the removable jaw 20. In other words, a side face of the cleat will contact a side wall of the recess (which is held in fixed relation to the vertical lateral datum surface 19) upon longitudinal insertion of the cleat within the recess to create a "slip fit" to laterally align the positioning plate. This lateral alignment is particularly important with angle positioning plates that must have mirror image alignment i.e., the lateral position of the angle plate 21A in the movable jaw must be precisely aligned with the lateral position of the positioning plate 21A in the fixed jaw so as not to skew the work piece position between the positioning plates during machining of the work piece. In FIG. 12B, the 45° angle positioning plate includes a key 16 having a length L' precisely machined to match the width of the keyway 17, thereby ensuring lateral alignment of the positioning plate upon insertion. The vertical side faces 16V of the key 16 contact the vertical lateral datum surface 19, thus using the keyway to obtain mirror image alignment of two opposing positioning plates.

Figure 13A:
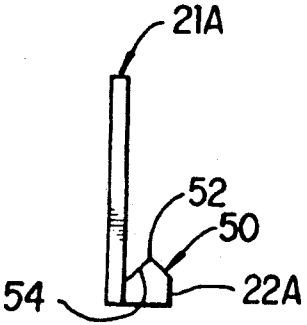
FIGS. 13A and 13B are side views of the positioning plates of FIGS. 12A and 12B, respectively.
Figure 13B:
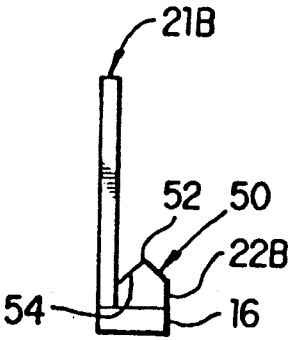

FIGS. 13A and 13B illustrate side views of the positioning plates 21A and 21B in FIGS. 12A and 12B. In FIG. 13A, the cleat 22 has a ramp surface 50 inclined upwardly in the securement direction to a ridge 52, and a securement surface 54 inclined downwardly in the securement direction from the ridge 52. The cleat 22B in FIG. 13B is similar but includes the key 16. Upon insertion of the cleat 22A or 22B into the recess 41, the detents 38 are urged to retract against the biasing force of the spring by contact with the ramp surface 50. After passing the ridge 52, the detents 38 project under the spring force while pressing against the securement surface 54. Since the spring force urges the detents 38 down the securement surface 54 (see FIG. 14B), the cleat 22A (or 22B) is drawn in the securement direction to draw the rear face 31A of the plate 21 into vertical longitudinal alignment against a front surface 25 of the jaw 20, while simultaneously urging the positioning plate 21A against the horizontal datum surface 24. The engagement of the lock screw 136 with the securement surface 54 creates a similar force for drawing the positioning plate in the securement direction. Three way alignment is thus achieved: 1) lateral alignment by contacting the side face of the cleat with the side wall of the recess (or the side face 16V of the key against vertical lateral datum surface 19); 2) horizontal alignment by contacting the positioning plate against the horizontal datum surface; and 3) vertical longitudinal alignment by drawing the rear face 31A against the front face 25 (vertical longitudinal datum surface).

The ramp surface 50 and the securement surface 54 in FIGS. 13A and 13B may extend for the entire lateral length of the cleat. Alternatively, the cleats 22A, 22B may be machined only in a location corresponding to the contact areas for the detents 38 and/or lock screw 136, to provide a ramp surface 50, ridge 52 and securement surface 54 only in the machined areas, the remainder of the cleat retaining a cross-section that does not include machined areas.

Figure 15A:
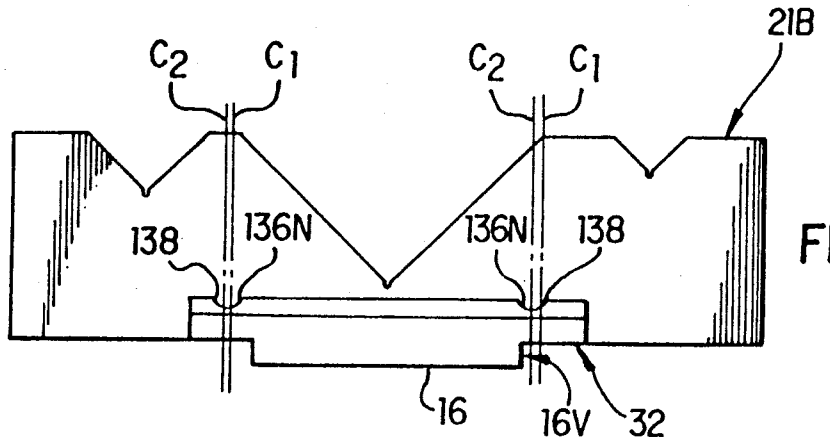
FIGS. 15A and 15B are front and side views, respectively, of a positioning plate similar to the positioning plate of FIGS. 12B and 13B.
Figure 16:
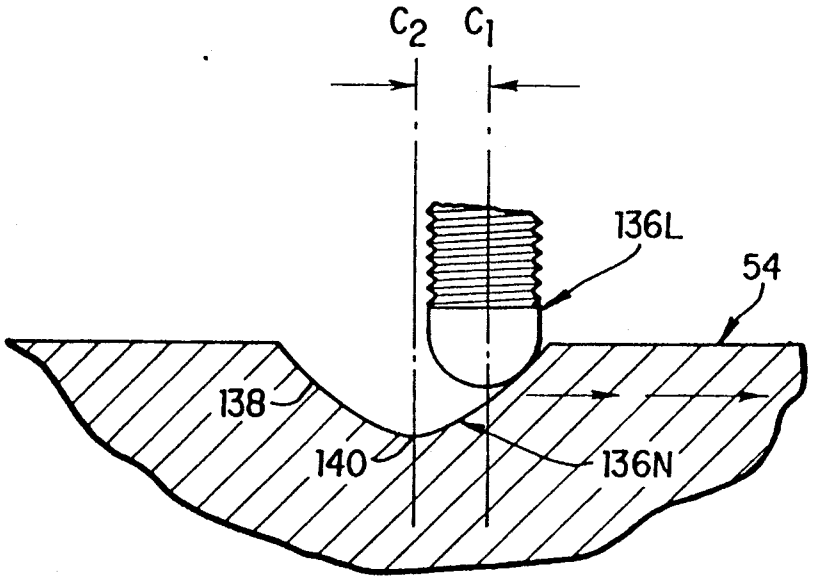
FIG. 16 is an enlarged view of the contact between the locking screw 136 (or detent 38) and the cleat 22B.
Figure 15B:
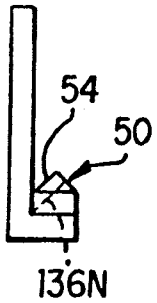

The length of the cleat 22A in FIG. 12A and the length of the key 16 on the cleat 22B in FIG. 12B require precise tolerances between the cleat or key and the recess or keyway, respectively, to obtain the contact or "slip fit" for lateral alignment. The structure in FIGS. 15A, 15B and 16 alleviates precise machining tolerances while maintaining lateral alignment. FIGS. 15A and 15B illustrate the positioning plate 21B of FIGS. 12B and 13B with the key 16, but the teachings of FIGS. 15A and 15B are applicable to the positioning plate 21A of FIGS. 12A, 13A without the key 16. The securement surface 54 of the cleat is provided with a lock notch 136N having inclined lateral side walls 138 sloping upwardly in the lateral direction from a nadir 140 (FIG. 16). Preferably, the lock notch 136N is concave. The centerline C2 of the lock notch 136N (i.e., a vertical axis through the nadir 140) is offset from the centerline C1 of the lock screw 136 and the jaw 20. Upon insertion of the cleat 22B in the recess 41, the lack of precise tolerances may permit lateral movement of the key 16 in the keyway 17. That is, a gap may exist between the keyway sidewall 16V and the vertical datum surface 19. To eliminate the gap and obtain lateral alignment by urging contact of the keyway sidewall 16V with the vertical datum surface 19, the lock screw 136 is extended into the lock notch 136N as illustrated in FIG. 16. But since the centerline C1 of the lock screw 136 is offset from the centerline C2 of the lock notch 136N, the locking end 136L engages the inclined sidewall 138 and is urged down the sidewall 138 toward the nadir 140 to move the positioning laterally in the direction indicated by the arrow in FIG. 16. Such lateral movement forces the keyway sidewall 16V into contact with the vertical datum surface 19 to obtain lateral alignment of the positioning plate in the jaw 20. The inclined surface 238 thus functions as a lateral alignment surface.

Figure 14A:
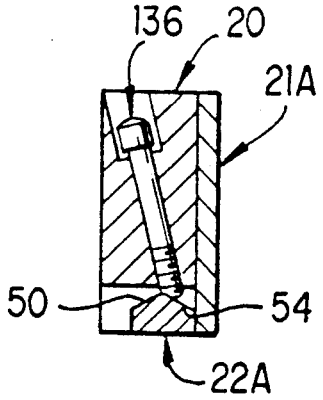
FIGS. 14A, 14B and 14C are cross-sectional views corresponding to FIGS. 11A, 11B and 11D, respectively, when the cleat is engaged in the recess.
Figure 14B:
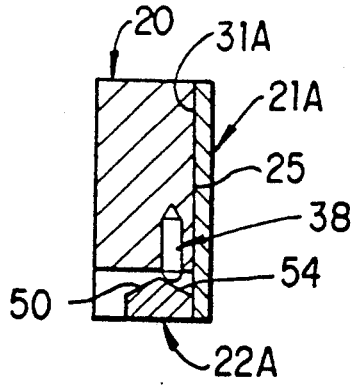

The lock screw 136 also urges the cleat in the securement direction and the bottom surface of positioning plate against the horizontal datum surface, as described with reference to FIG. 14A. The lock screw/offset lock notch thus provides three-way positioning: 1) lateral alignment against the vertical lateral datum surface; 2) horizontal alignment against the horizontal datum surface; and 3) vertical longitudinal alignment against the front surface 25 of the jaw 20.

If the positioning plate 21A of FIGS. 12A and 13A is used, a side face of the cleat will be moved into contact with the side wall of the recess for lateral alignment. Accordingly, the side face of the cleat can be located on the cleat itself (FIGS. 12A and 13A) or on the key depending from the cleat (FIGS. 12B and 13B).

The concept of offset centerlines of the lock screw 136 and lock notch 136N are applicable to the detents 38 and corresponding depressions D. That is, the depressions D can have inclined lateral sidewalls such that the detent 38 engages a sidewall (due to the offset centerlines of the detent 38 and depressions D) to urge the key 16 laterally into contact with the vertical datum surface 19. Simultaneously, the detents 38 urge the bottom face 32 against the horizontal datum surface 24. The rear face 31 is also urged into vertical alignment against the front surface 35 of the jaw.

As noted above, in the embodiment of FIGS. 9–16, the positioning plate approaches the jaw 20 in the longitudinal securement direction and is released from the jaw 20 by movement in the opposite longitudinal release direction, as opposed to the approach and release of the positioning plate in the lateral direction in the embodiment of FIGS. 1–7. The finger recesses 60 (FIG. 9) may assist in releasing the positioning plate from the jaw 20. Often times, however, several vises are arranged side by side, thus precluding use of the finger recesses 60 since there is insufficient space between the vises for the operator's fingers to engage the finger recess. Further, the finger recess weakens the jaw and is not readily adaptable to computer controlled release of the positioning plate. To obviate these disadvantages, the jaw 20 is provided with a release mechanism 70 illustrated in FIGS. 10, 11D, 11E and 14C.

The release mechanism 70 is located within a bore 72 in the jaw 20 that extends from the top surface of the jaw and opens into a cavity 74 that communicates with the recess 41. The release mechanism itself includes a kick-out lever 76 which pivots within the cavity 74. One end of the kick-out lever 76 includes a cam 78 which projects into the recess 41. The other end of the kick-out lever 76 is attached to a vertical shaft 80 in the bore 72. The shaft 80 (and thus the kick-out lever 76 and cam 78) is held within the bore 72 by a retainer screw 82 located in the cavity 74. The end of the shaft 80 adjacent the top surface of the jaw is provided with a recessed engagement mechanism whereby a tool can engage the shaft 80 to rotate the shaft 80 in the bore 72. Such rotation causes the cam 78 to pivot Within the cavity 74. The cavity has a size sufficient to permit the cam 78 to assume a position in the rear of the cavity so as not to interfere with insertion of the cleat 22A in the recess 41 (see FIG. 14C).

Figure 11A:
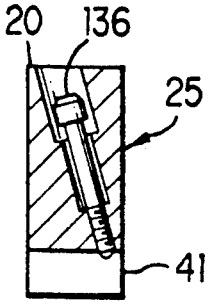
FIG. 11A, 11B and 11C are cross-sectional views of the jaw of FIG. 10 taken along the lines A—A, B—B and C—C, respectively, of FIG. 10.
Figure 11B:
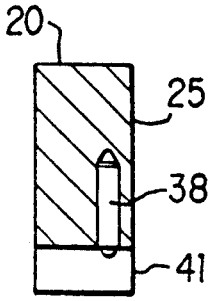
Figure 11C:
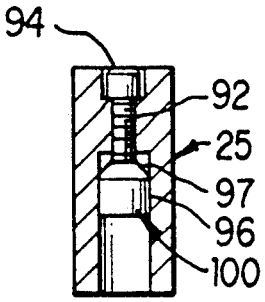
Figure 11D:
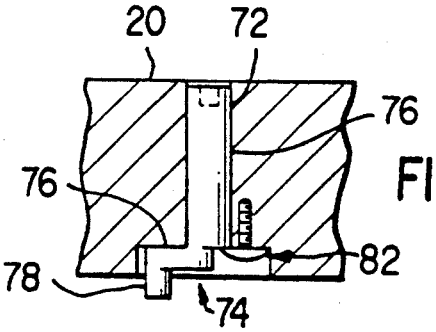
FIG. 11D is a cross-sectional view of the jaw of FIG. 10 taken through the release mechanism 70.
Figure 11E:
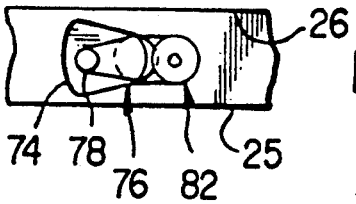
FIG. 11E is a bottom view of the release mechanism 70 in FIGS. 10 and 11D.
Figure 14C:
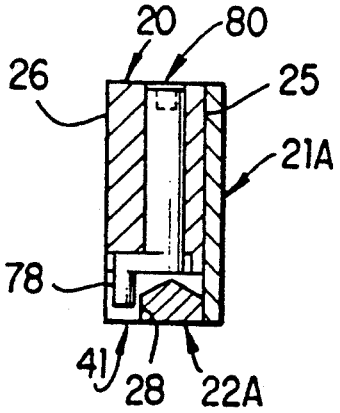

The operation of the release mechanism is illustrated in FIGS. 11D, 11E and 14C. Upon insertion of the cleat 22A and the recess 41, the rear face 28 of the cleat 22A contacts the cam 78 and pushes it toward the rear face of the cavity 74 adjacent the rear surface 36 of the jaw 20. The cleat is then secured in the jaw by the detents 38 and lock screw 136 (if necessary). To release the positioning plate 21A, the shaft 80 in the bore 72 is rotated to pivot the cam 78 from the rear of the cavity 74 to the front of the cavity 74 adjacent the front surface 25. The cam 78 contacts the rear face 28 of the cleat 22A to push the cleat in the release direction. That pushing is initially resisted by the spring force of the detents 38 as the detents retract while sliding up the securement surface 54. However, once the detents 38 pass the ridge 52, the detents aid in moving the positioning plate in the release direction as the detents 38 project under the spring force while sliding down the ramp surface 50.

Figure 17A:
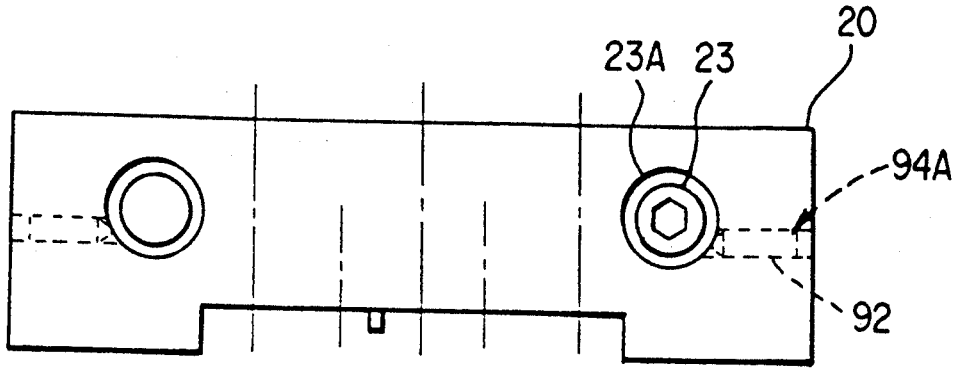
FIGS. 17A and 17B are front and partial cross-sectional views, respectively, of another embodiment for the bolt head locks of FIG. 10.
Figure 17B:
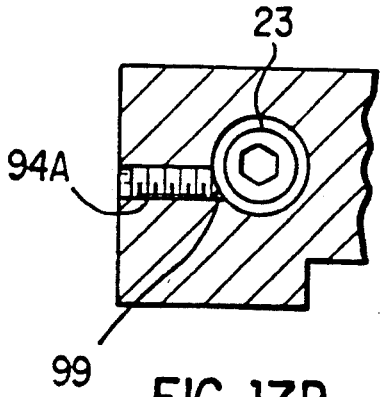

When the jaw 20 of FIG. 10 is bolted to the movable or fixed jaw of the vise 10 (FIGS. 1, 8A and 8B), there is a possibility that the bolt 23 may loosen over time. If the bolt 23 loosens, the removable jaw 20 may shift, thereby introducing an error when the positioning plates are secured within the removable jaw. Further, there is a clearance between the inside diameter of the fastening bore 23A and the outside diameter of the bolt 23. This clearance may permit slight shifting of the removable jaw 20 in the lateral and vertical directions relative to the vertical lateral datum surface 19 and the horizontal datum surface 24. To prevent such shifting or loosening of the bolts 23, the jaw 20 (see FIGS. 10 and 11C) can be provided with bolt head locks 90 located in a bore 92 positioned transverse to but communicating with the fastening bore 23A of the bolt 23. The bolt head lock 90 includes an engagement screw 94 located within a first portion of the bore 92 adjacent the top surface of the jaw, and a lock 96 within a second portion of the bore 92. The lock nut 96 preferably has a tapered end 97. Rotation of the engagement screw 94 in one direction draws the lock nut 96 toward the top surface to engage the tapered end 97 with the head of the bolt 23, preferably below the center-line of the bolt 23, thereby tightening up the clearance and trapping the removable jaw in position relative to the horizontal and vertical datum surfaces 24 and 19 while locking the bolt 23 against rotation and thus inhibiting loosening of the jaw from the fixed or movable jaw. The bore 92 intersecting the fastening bore of the bolt 23 need not be vertically oriented as illustrated in FIGS. 10 and 11C. FIGS. 17A and 17B illustrate horizontally oriented bores 92 intersecting the fastening bore 23A. Also in FIGS. 17A and 17B, the engagement screw may be modified to be a set screw 94A having one end 99 for contacting the bolt head 23 and holding it in place against rotation. In the embodiment of FIGS. 10 and 11C and FIGS. 17A and 17B, the removable jaw is sandwiched or trapped between the bolt 23 and horizontal datum surface to lock it in position relative to the horizontal and vertical datum surface 24, 19.

Figure 18A:
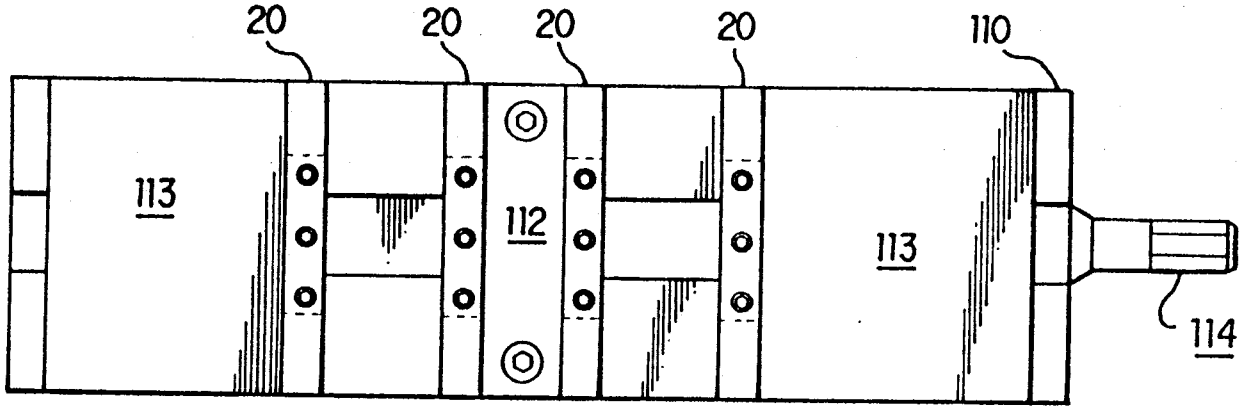
FIGS. 18A and 18B are top and side views, respectively, of a double vise to which the invention is applicable.
Figure 18B:
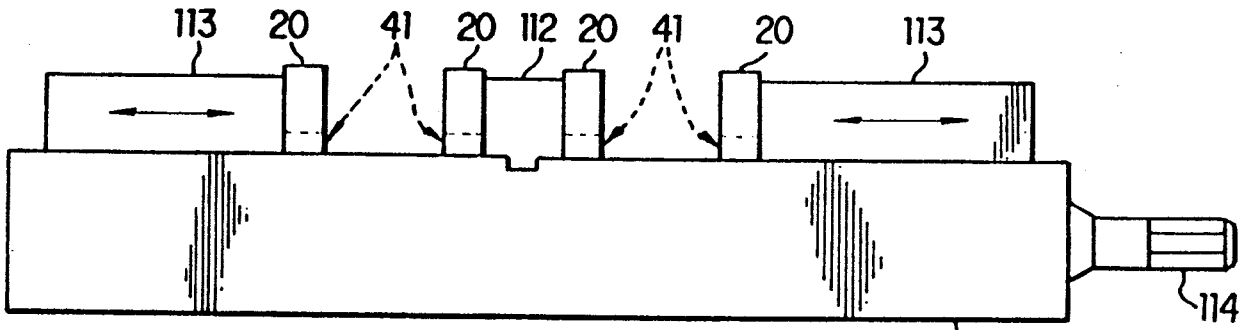
Figure 19A:
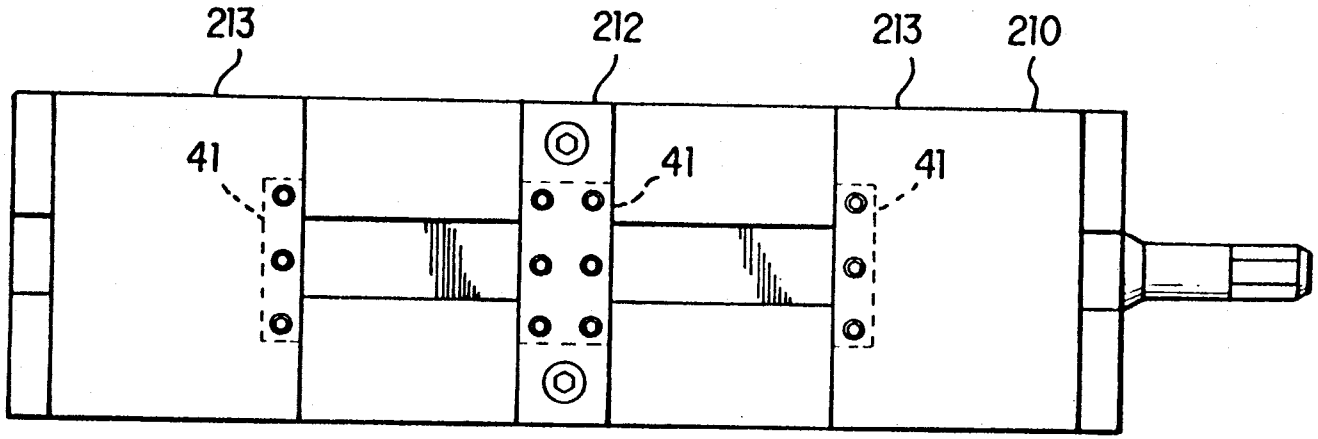
FIGS. 19A and 19B are top and side views, respectively, of another double vise to which the invention is applicable.
Figure 19B:
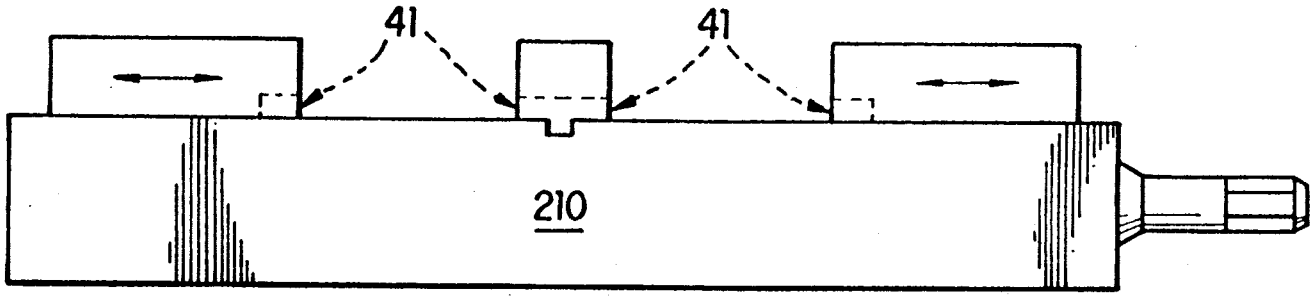

While the foregoing structure has been described with reference to the single vise of FIGS. 1, 8A and 8B, the inventive structure is applicable to the double vise of FIGS. 18A, 18B, 19A and 19B. In FIGS. 18A and 18B, the vise 110 has two movable jaws 113 which reciprocate by rotation of the screw 114 relative to a stationary central jaw 112. Each jaw has a removable jaw 20 bolted to it, with each removable jaw having the structure of FIG. 10 (i.e., the recess 41, detents 38, lock screw 136 and release mechanism 70). The central jaw 112 has two removable jaws 20 bolted to each side. The vise 210 of FIGS. 19A and 19B is similar to the vise 110 of FIGS. 18A and 18B, but the vise 210 has built in recesses 41 accommodating the structure of FIG. 10 in the central jaw 212 and the removable jaws 213. The recess 41 in the central jaw 212 preferably extends through the jaw 212.

Figure 20C:
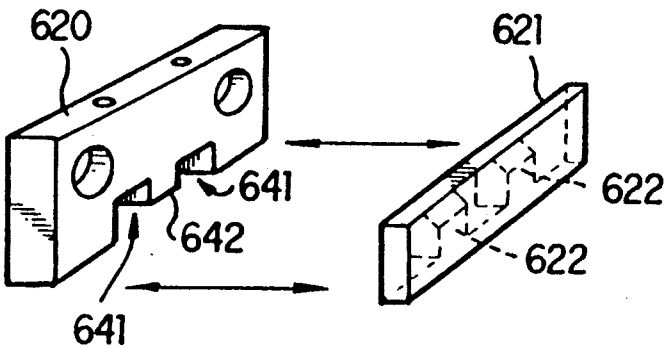
FIGS. 20A, 20B and 20C are respectively a front view of a modified jaw 620, a front view of a modified positioning plate 621, and a perspective view of the insertion of the modified positioning plate into the modified jaw.
Figure 20A:
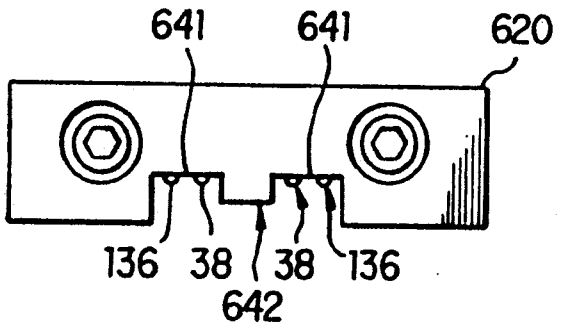
Figure 20B:
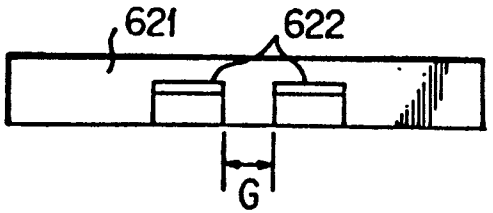
Figure 21:
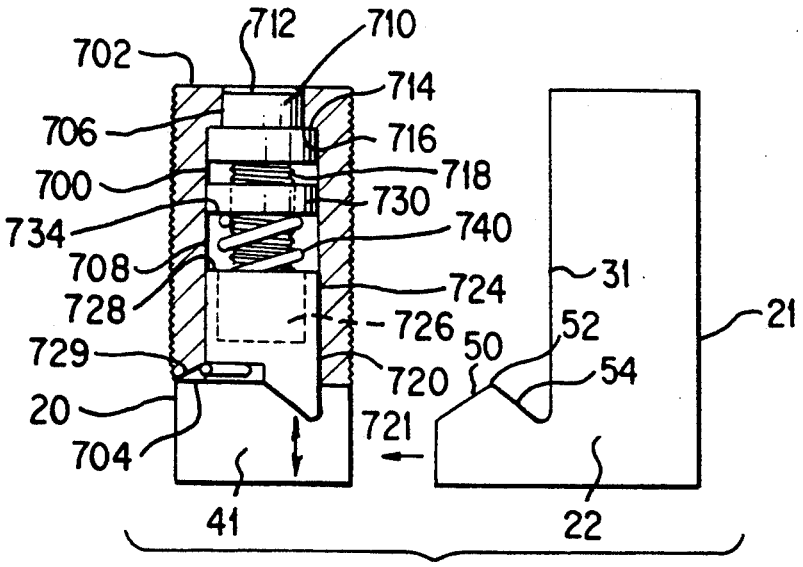
FIG. 21 is a cross-sectional edge view of a combined spring biasing/locking mechanism according to another aspect of the present invention for holding a cleat of a positioning plate in position.
Figure 22A:
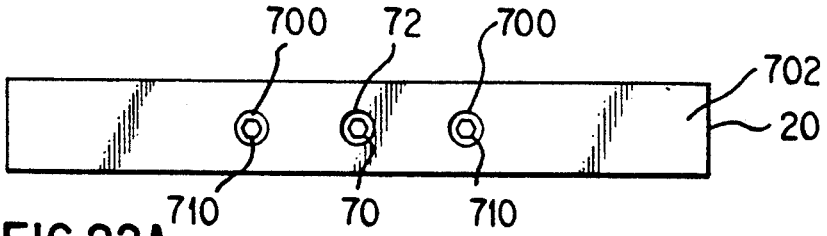
FIGS. 22A, 22B and 22C are top, side and bottom views, respectively, of the removable jaw of FIG. 21 having the spring biasing/locking mechanism of FIG. 21 with FIG. 21 being taken along the line A—A of FIG. 22B.
Figure 22B:
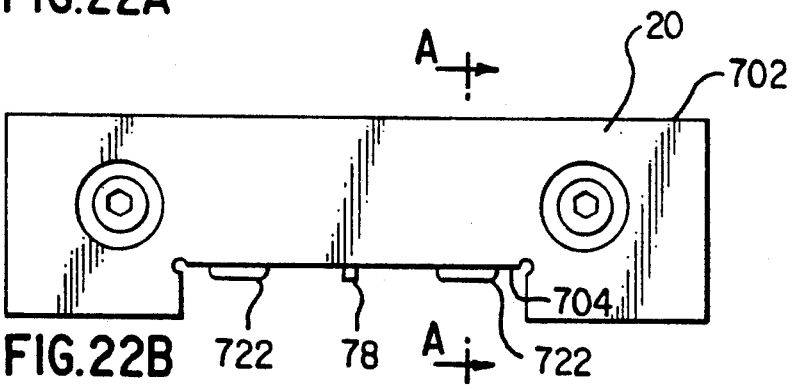
Figure 22C:
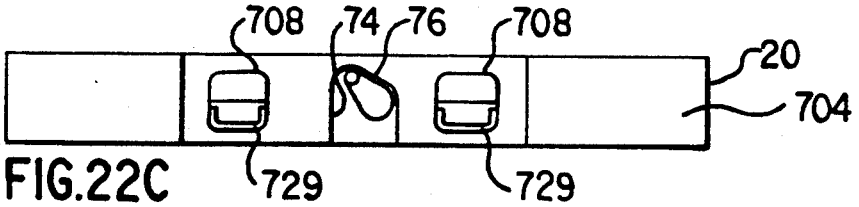

Other recess shapes are available to obtain lateral alignment of the positioning plate relative to the jaw as illustrated in FIGS. 9, 10, 12 and 13. As illustrated in FIGS. 20A, 20B and 20C, the shape of the recess in the jaw 620 can be modified to include two portions 641, with an orientation key 642 between the portions 641. Each recess portion 641 includes a detent 38 and/or lock screw 136. The positioning plate 621 includes two correspondingly shaped cleats 622, spaced apart by a gap G precisely machined to receive the orientation key 642. When the positioning plate 621 is longitudinally inserted into the jaw 620, the cleats 622 are received within the recesses 641, while the gap G receives the orientation key 642. The size of the gap is machined to the size of the orientation key to minimize lateral movement of the plate 621 in the jaw 620. However, if machining tolerances are such that a space exists between the orientation key 642 and the gap between the cleats 622, the cleats can be provided with lock notches and/or depressions cooperating with offset lock screws and/or detents, respectively, to obtain lateral alignment as described with reference to FIGS. 15 and 16.

Figure 23A:
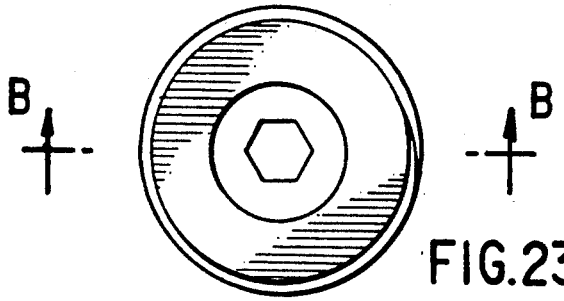
FIGS. 23A, 23B and 23C are top, cross-sectional, and bottom views of a clamping mechanism similar to FIG. 21, with FIG. 23B being taken along the line B—B of FIG. 23A.
Figure 23B:
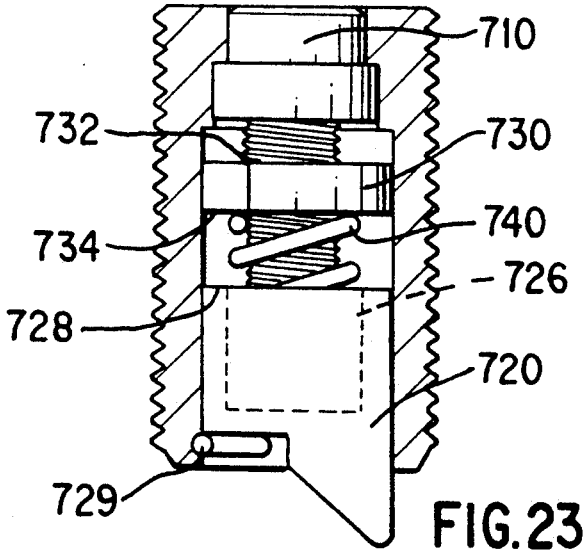
Figure 23C:
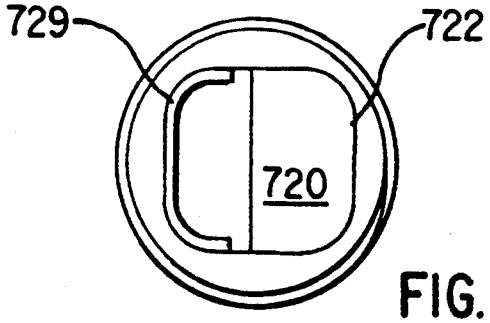

In another embodiment as illustrated in FIGS. 21 and 22A, 22B and 22C, the spring biased detent arrangement and the lock screw arrangement are combined into a single mechanism, which takes up less space than the prior embodiment and provides more locking strength. This single biasing/locking arrangement will be described with reference to holding a cleat 22 of a positioning plate 21 in a removable jaw 20. However, those skilled in the art recognize that the biasing/locking arrangement is a clamping mechanism usable in any clamping device for holding an element in a fixed position relative to the clamping device, as illustrated in FIGS. 23A, 23B and 23C. The biasing/locking arrangement can also be enclosed in any housing that can be conveniently positioned in many different situations to solve many different clamping situations. For example, as illustrated in FIG. 23B, an outside surface of the housing can be threaded or have other means for attachment to the clamping device.

As illustrated in FIGS. 21 and 22A, 22B and 22C, a bore 700 is located on each side of the bore 72 for the release mechanism 70. The bore 700 extends through the removable jaw 20 and opens in the top (first ) and bottom (second) surfaces 702, 704 of the removable jaw. It is noted, however, that the surfaces need not be opposing surfaces: the bore could be inclined to extend, for example, between the top surface and the front face of the removable jaw. The bore 700 has two portions: a first portion 706 preferably having a circular cross-section opening to the first top surface 702; and a second portion 708 opening to the second bottom surface 704. The second portion 708 is preferably non-circular and larger than the first portion 706.

An actuating screw 710 is inserted from the second surface 704 through the second portion 708 and into the first portion 706. A head portion 712 of the screw 710 is located in the first portion 706, and preferably retained therein by a shoulder 714 in the first portion 706 of the bore 700 engaging a collar 716 on the head portion 712. Both the head portion 712 and collar 716 have circular cross-sections corresponding in size to the circular cross-section of the first portion 706 of the bore 700, which includes the shoulder 714 having a slightly enlarged diameter for allowing the head portion 712 to pass the shoulder 714 but prevent the collar 716 from passing to the first top surface 702.

The actuator screw 710 also includes a threaded shank 718 extending from the head portion 712 into the second portion 708 of the bore 700. As will become apparent from the following, the actuating screw is rotatable in the bore, but is axially immovable within the bore, i.e., rotation of the screw 710 does not result in a change in axial position of the screw 710 in the bore 700. Other arrangements are possible, however, that would allow the actuating screw to move axially like a set screw against the spring or lock member (described below) and still achieve the advantages of the present invention.

A plunger 720 is located in the second portion 708 of the bore 700. The plunger 720 preferably has a non-circular cross-section that matches the non-circular cross-section of the second portion 708 of the bore 700 so that the plunger 720 is not rotatable in the bore 700, but is capable of axial movement within the second portion 708 of the bore 700. The plunger 720 has a first axial end 722 projecting from the second bottom surface 704 of the removable jaw 20 into the recess 41 for engaging the cleat 22 of the positioning plate 21. The first axial end 722 can be inclined to cooperate with the ramp surface 50 on the cleat 22, but other configurations are possible depending upon the element to be engaged by the plunger 720. The second opposite axial end 724 of the plunger 720 has a recess 726 therein, the recess 726 defining a perimeter surface 728. A retainer clip 729 holds the plunger 720 within the bore 700 so the plunger 720 cannot fall out of the second portion 708 of the bore. Other retainer mechanisms could be used.

A lock member 730 is located in the second portion 708 of the bore 700 between the head portion 712 of the actuating screw 710 and the plunger 720. The lock member 730 has an internally threaded aperture which engages the threaded shank 718 of the screw 710 and a contact surface 734 which surrounds the aperture. The lock member 730 preferably has a non-circular crosssection that corresponds in size to the non-circular cross-section of the second portion 708 of the bore 700 so that upon rotation of the screw 710, the lock member is not capable of rotation (due to engagement of the walls of the bore 700 with the outer surfaces of the lock member), but is capable of axial movement within the second portion 708 of the bore 700 (due to the threaded engagement of the aperture 732 on the threaded shank 718). It is noted, however, that other configurations are possible for permitting axial movement of the plunger 720 and lock member 730 within the second portion 708 of the bore 700 while preventing rotation of the plunger 720 and lock member 730 about the longitudinal axis of the bore 700. For example, the second portion of the bore could have a circular cross-section with an axially oriented keyway in the wall of the bore for engaging a key projecting from the outer surfaces of the plunger and lock screw, but would allow axial movement of the plunger and lock screw when the key rides axially within the keyway. The key could be located in the wall of the bore and the keyway in the outer surfaces of the plunger and lock screw, if desired.

A spring 740, preferably a coil spring, is located about the threaded shank 718 and between the contact face 734 of the lock member 730 and the recess 726 of the plunger 720. The recess 726 of the plunger 720 is sized sufficiently to contain the spring 740 therein when the spring 740 is compressed completely. Because the threaded shank 718 locates the lock member 730 in a selected axial position, the spring 740 exerts a biasing force onto the plunger 720. The plunger 720, however, can move axially upward when the biasing force is overcome. Axial movement of the lock member 730 on the shank 718 will vary the biasing force.

To assemble the mechanism, the actuating screw 710, preferably having the lock member 730 threadably located on the shank 718, is inserted from the second bottom surface 704 until the collar 716 engages the shoulder 714 to retain the head portion 712 in the first portion 702 of the bore 700. The spring 740 is then inserted into the bore from the second bottom surface 704 and located against the contact face 734 of the lock member 730. The plunger 720 is then inserted through the second bottom surface 702 such that the recess 726 of the plunger receives the spring 740. The retainer clip 729 is then inserted to prevent the plunger 720 (and the other elements of the mechanism) from falling out of the bore 700.

In operation, rotation of the actuating screw 710 axially moves the lock member 730 relative to the plunger 720 to vary the biasing force of the spring 740 on the plunger 720. In this connection, sliding of the cleat 22 into the recess 41 will urge the plunger 720 upward against the biasing force until the first axial end 722 of the plunger reaches the ridge 52 of the ramp surface 50 on the cleat 22. The biasing force will then urge the plunger 720 downward to hold the cleat 22 in position as described with reference to the previous embodiments. When it is desired to lock the cleat 22 in position, the biasing force is disabled by rotating the actuating screw 710 to compress the spring 740 completely within the recess 726 of the plunger 720. The contact face 734 of the lock member 730 will then contact the perimeter surface 728 of the plunger 720 to prevent upward movement of the plunger and thus lock the cleat in position. The cleat is unlocked to reinstate the biasing force by rotating the actuating screw in an opposite direction to move the contact face 734 away from the perimeter surface 728 and allow the spring 740 to expand.

The invention has been described above with reference to parallel plates and angle plates, all of which constitute positioning plates in the context of the invention. The invention is equally applicable to other vise accessories having jaw plates that must be detachably mounted to a vise without sacrificing positional accuracy. The term positioning plate is intended to encompass such accessories. Further, the invention has been described with reference to its preferred embodiments which are intended to be illustrative and not limiting. For example, in the preferred embodiment, the removable jaw has a bottom surface that contacts the horizontal datum surface. The removable jaw, however, may have a bottom surface that is not in contact with the horizontal datum surface, but still held in a fixed relationship to the horizontal datum surface. In addition, the pressure means may be modified to be two or more separate mechanisms, one for urging the positioning plate against the horizontal datum surface, and one for urging the positioning plate in the securement direction against the front face 25 of the removable jaw. These and various other changes may be made without departing from the spirit and scope of the invention as defined in the following claims.

What is claimed is:

1. A clamping mechanism in a clamping device for holding an element in a fixed position relative to the clamping device, the clamping mechanism comprising:

a bore extending through the clamping device and opening first and second surfaces of the clamping device, the bore including a first portion having a circular cross-section opening to the first surface and a second portion opening to the second surface;

an actuating screw having a head portion located within the first portion of the bore and a threaded shank extending into the second portion of the bore, the actuating screw being rotatable within the bore;

a plunger located in the second portion of the bore for non-rotatable axial movement within the second portion of the bore, the plunger having a first axial end projecting from the second surface for engaging the element and a second opposite axial end having a recess therein, a perimeter surface being defined on the second axial end by the recess, the plunger including means for retaining the plunger within the bore;

a lock member having an internally threaded aperture threadably engaged with the threaded shank and a contact surface surrounding the aperture, the lock member being located within the second portion of the bore for non-rotatable axial movement within the bore upon rotation of the threaded shank of the actuating screw; and a spring located about the threaded shank and between the contact face of the lock member and the recess of the plunger, rotation of the actuating screw axially moving the lock member relative to the plunger to vary a biasing force exerted by the spring on the plunger, the contact face of the lock member selectively compressing the spring completely within the recess of the plunger to permit the contact face to contact the perimeter surface of the plunger to prevent axial movement of the plunger within the bore.

2. The clamping mechanism of claim 1, wherein the second portion of the bore has a non-circular crosssection.

3. The clamping mechanism of claim 2, wherein the lock member has a non-circular cross-section corresponding to the non-circular cross-section of the second portion of the bore to prevent rotation of the lock member within the bore.

4. The clamping mechanism of claim 2, wherein the plunger has a non-circular cross-section corresponding to the non-circular cross-section of the second portion of the bore to prevent rotation of the plunger within the bore.

5. The clamping mechanism of claim 1, wherein the lock member includes means for engaging a wall of the second portion of the bore to prevent rotation of the lock member while permitting axial movement of the lock member upon rotation of the threaded shank.

6. The clamping mechanism of claim 1, wherein the plunger includes means for engaging a wall of a second portion of the bore to prevent rotation of the plunger while permitting axial movement of the plunger.

7. The clamping mechanism of claim 1, wherein the actuating screw includes a shoulder having a size greater than a diameter of the first portion of the bore to retain the actuating screw within the bore.

8. The clamping mechanism of claim 1, wherein the means for retaining the plunger within the bore is a retainer clip fixed in the second portion of the bore.

9. The clamping mechanism of claim 1, wherein the clamping device is a removable jaw of a vise, and the element is a cleat of a positioning plate selectively attached to the vise.

10. The clamping mechanism of claim 1, wherein the actuating screw is axially restrained within the bore so as to be rotatable but axially immovable.

11. The vise jaw system for a vise having a datum surface, the system comprising:

at least one removable jaw for selective attachment to said vise, said removable jaw having a bottom surface held in fixed relation to said datum surface and a front surface perpendicular to said datum surface, said removable jaw further including a recess formed in said bottom and front surfaces of the removable jaw;

at least one positioning plate for selective attachment to said removable jaw, said positioning plate having a bottom face for contacting the datum surface and a rear face perpendicular to said datum surface;

said positioning plate further including a cleat fixed to the positioning plate adjacent to the bottom face of the positioning plate, said cleat having a shape sized for reception of said cleat in said recess; and pressure means located in one of the removable jaws and the cleat for engaging said cleat when received in said recess to urge the bottom face of said positioning plate against said datum surface without movement of the positioning plate, wherein the pressure means comprises:

a bore in first and second surfaces of one of the removable jaw and the cleat, the bore including a first portion having a circular cross-section opening to the first surface and a second portion opening to the second surface;

an actuating screw having a head portion located within the first portion of the bore and a threaded shank extending into the second portion of the bore, the actuating screw being rotatable within the bore;

a plunger located in the second portion of the bore for non-rotatable axial movement within the second portion of the bore, the plunger having a first axial end projecting from the second surface and a second opposite axial end having a recess therein, a perimeter surface being defined on the second axial end by the recess, the plunger including means for retaining the plunger within the bore;

a lock member having an internally threaded aperture threadably engaged with the threaded shank and a contact surface surrounding the aperture, the lock member being located within the second portion of the bore for non-rotatable axial movement within the bore upon rotation of the threaded shank of the actuating screw; and a spring located about the threaded shank and between the contact face of the lock member and the recess of the plunger, rotation of the actuating screw axially moving the lock member relative to the plunger to vary a biasing force exerted by the spring on the plunger, the contact face of the lock member selectively compressing the spring completely within the recess of the plunger to permit the contact face to contact the perimeter surface of the plunger to prevent axial movement of the plunger within the bore.

12. The system of claim 11, wherein the second portion of the bore has a non-circular cross-section.

13. The system of claim 12, wherein the lock member has a non-circular cross-section corresponding to the non-circular cross-section of the second portion of the bore to prevent rotation of the lock member within the bore.

14. The system of claim 12, wherein the plunger has a non-circular cross-section corresponding to the non-circular cross-section of the second portion of the bore to prevent rotation of the plunger within the bore.

15. The system of claim 11, wherein the lock member includes means for engaging a wall of the second portion of the bore to prevent rotation of the lock member while permitting axial movement of the lock member upon rotation of the threaded shank.

16. The system of claim 11, wherein the plunger includes means for engaging a wall of a second portion of the bore to prevent rotation of the plunger while permitting axial movement of the plunger.

17. The system of claim 11, wherein the actuating screw includes a shoulder having a size greater than a diameter of the first portion of the bore to retain the actuating screw within the bore.

18. The system of claim 11, wherein the means for retaining the plunger within the bore is a retainer clip fixed in the second portion of the bore.

19. The system of claim 11, wherein the pressure means urges the rear surface of the positioning plate against the front surface of the removable jaw.

20. The system of claim 11, wherein the cleat has an upper surface, and the pressure means is located in the removable jaw and contacts the upper surface of the cleat.

21. The system of claim 11, wherein the actuating screw is axially restrained within the bore so as to be rotatable but axially immovable.

* * * * *